US005539434A

United States Patent [19]

Fuse

[11] Patent Number: 5,539,434

[45] Date of Patent: Jul. 23, 1996

[54] INK JET RECORDING APPARATUS AND METHOD THEREFOR

[75] Inventor: Takeshi Fuse, Kanagawa, Japan

[73] Assignee: Fuji Xerox Co., Ltd., Tokyo, Japan

[21] Appl. No.: 56,391

[22] Filed: May 4, 1993

[30] Foreign Application Priority Data

May 6, 1992 [JP] Japan ..... 4-140936

[51] Int. Cl.[6] ..... B41J 2/01; B41J 2/13

[52] U.S. Cl. ..... 347/19; 347/40

[58] Field of Search ..... 346/1.1, 139 R, 346/140 R; 400/82, 74, 703, 709, 709.2; 395/105; 347/5, 19, 40, 49, 43, 14

[56] References Cited

U.S. PATENT DOCUMENTS 4,345,262 8/1982 Shirato et al. ..... 346/140 R
5,297,017 3/1994 Haselby et al. ..... 347/19

FOREIGN PATENT DOCUMENTS 61-27270 2/1986 Japan .
62-77951 4/1987 Japan .
62-109657 5/1987 Japan .
2-243373 9/1990 Japan .

*Primary Examiner*—Huan H. Tran
*Assistant Examiner*—Alrick Bobb
*Attorney, Agent, or Firm*—Finnegan, Henderson, Farabow, Garrett & Dunner

[57] ABSTRACT

An ink jet recording apparatus having a plurality of recording head units, a test printing operation is carried out to detect the amounts of shift in position of the resultant records, and the amounts of shift thus detected is utilized for determining the maximum number of nozzles to be used and the positions of them for each recording head unit. The number of nozzles to be used is compared with a minimum unit of sheet feed, and determined so that the number of nozzles and the minimum unit are most suitably compatible with each other. In a printing operation, the use of nozzles is controlled, and the amount of feed of the recording sheet is set to the print width which corresponds to the number of nozzles to be used.

15 Claims, 5 Drawing Sheets

INK JET RECORDING APPARATUS AND METHOD THEREFOR

BACKGROUND OF THE INVENTION

1. Field of the Invention

This invention relates to an ink jet recording apparatus and method, in which a plurality of recording head units which are detachably mounted each having a plurality of nozzles are employed, and the recording head units and a recording medium are moved relative to each other, to perform a monochromatic printing operation and a color printing operation, and more particularly to an ink jet recording apparatus and method, in which the shift in position of a print, in the direction of arrangement of nozzles, of each recording head unit is corrected.

2. Description of the Prior Art

In the case of an ink jet recording apparatus in which a plurality of recording head units which are detachably mounted on a carriage each having a plurality of nozzles, which carriage is moved with respect to a recording medium, prints formed by the recording head units are put one on another. However, if the prints are shifted in position (hereinafter referred to as "print shifts", when applicable) for instance because the recording head units are mounted on the carriage with dimensional errors, then the resultant print is lower in picture quality as much. If a color printing operation is carried out with recording head units having mounting errors, the prints are shifted in position; that is, it is impossible to accurately put different color ink droplets one on another, which results in the mixture of colors, and the nonuniformity of color. This problem of picture quality is more serious according as the recording head units are improved in resolution.

If the recording head units on a printer are semi-permanently long in service life, then, their mounting positions can be adjusted only when shipped out of the factory; that is, if the positions are adjusted once, then it is no longer required to perform the adjustment again. However, in replacement of the recording head units which are replaceable units, the new ones are not always set at the same positions for instance because of their mechanical tolerances and mounting errors, and therefore the above-described print shift is liable to occur.

On the other hand, the recording head must be installed with higher accuracy in proportion to the increasing resolution thereof. In the recording system in which a plurality of recording head units are mounted individually, it is considerably difficult to mount them without positional shift.

In order to mount the recording head units in position with high accuracy, an adjusting mechanism may be added to the carriage. However, this method is disadvantageous in the following points: The carriage body is increased in manufacturing cost and it becomes bulky. In addition, it is difficult and troublesome to adjust each of the recording head units; that is, whenever the adjustment is performed, it is necessary to print with the recording head units thus adjusted to ensure whether or not the adjustment is satisfactory. Thus, the adjustment takes a lot of time and labor.

A multi-nozzle ink jet recording apparatus in which a plurality of recording heads each having a plurality of nozzles are mounted on a carriage which moves relative to a recording medium, and the positional shift of prints in the direction of arrangement of the nozzles (hereinafter referred to as "a nozzle arrangement direction", when applicable) between the recording head units is corrected, has been disclosed, for instance, by Unexamined Japanese Patent Publication (Kokai) Sho-62-77951/(1987).

The multi-nozzle ink jet recording apparatus is designed as follows: Each of at least (N−1) recording head units (where N is the number of recording head units mounted on the carriage), has nozzles the number of which is larger than a predetermined number of nozzles which are actually used for printing, so as to adjust the prints in the nozzle arrangement direction between the recording head units; that is, the print shift is corrected by selecting a predetermined number of nozzles in a proper position.

In the above-described conventional method, the number of nozzles selected is constant (for instance 24) at all times, and with the maximum positional shift taken into account, nozzles more than the constant must be provided; that is, extra nozzles must be provided. Hence, in the case where the recording head units mounted are less in positional shift, the number of nozzles which are not actually used is increased as much.

On the other hand, it is necessary to provide more extra nozzle in proportion to the increasing resolution of a recording head, and therefore the number of nozzles which are normally not used for printing is further increased. This fact results in an increase in manufacturing cost of the recording head, and in insufficient use of the recording ability of the recording head.

In the above-described multi-nozzle ink jet recording apparatus, the positional shift is detected by the following method: That is, the apparatus is operated to print actually, and the resultant print is used for correction of the positional shift. A prior art concerning the method has been disclosed by Unexamined Japanese Patent Publication (Kokai) No's Sho-62-109657/(1987) and Hei-2-243373/(1990). Those applications relate to a technique that, in a printing operation, prints are aligned with each other in position in a reciprocation mode. In the technique, printing is actually performed, to detect the positional shift of the prints, thereby to correct it. More specifically, a test printing operation is carried out with the printing timing changed for the "go" and "return" movements of the carriage until the print shift is eliminated. This conventional technique is applicable also to the correction of a print shift in a color printing operation.

In the conventional technique, the carriage is reciprocated several times until the print shift is eliminated, and a value considered to be optimum is inputted. If the print shift is large, the carriage must be reciprocated many times, and the printing also must be carried out many times. As a result, one sheet of recording paper may be used up only for correction of the print shift. That is, the conventional technique is disadvantageous in that it is not economical.

SUMMARY OF THE INVENTION

In view of the foregoing, an object of this invention is to provide an ink jet recording apparatus and an ink jet recording method in which the mounting errors, in the nozzle arrangement direction, of the recording head units are corrected, so that the resultant record is satisfactory in picture quality at all times, and the nozzles of the recording head units can be used with high efficiency. Another object of the invention is to efficiently perform a test recording operation for correction of the mounting errors.

According to the first aspect of the invention, an ink jet recording apparatus which performs a printing operation with a plurality of recording head units which are detachably mounted each having N nozzles arranged in a line, comprises: recording head control means for allowing each recording head unit to use n nozzles which are selected out of the N nozzles according to a common print region of the plurality of recording head units, to perform a printing operation.

Furthermore, the number n of nozzles thus selected is the maximum number of nozzles which can print in the common print region of the plurality of recording head units.

Furthermore, the above described ink jet recording apparatus further comprises: control means for performing the relative movement of each recording head unit and a recording medium as much as the print width of the n nozzles thus selected.

According to second aspect of the invention, an ink jet recording method in which a plurality of recording head units which are detachably mounted each having N nozzles arranged in a line are used to perform a printing operation, according to the invention, each recording head unit is allowed to use n nozzles which are selected out of the N nozzles according to a common print region of the plurality of recording head units, to perform a printing operation.

Furthermore, in the method, the number n of nozzles thus selected is the maximum number of nozzles which can print in the common print region of the plurality of recording head units.

Furthermore, the number n of nozzles thus selected is the number of nozzles which is determined according also to a minimum movement unit in the relative movement of each recording head unit and a recording medium.

Furthermore, when no print shift occurs, all the N nozzles are used for printing.

Furthermore, in an ink jet recording method in which a plurality of recording head units which are detachably mounted each having N nozzles arranged in a line are used to perform a printing operation, printing is carried out while, with respect to nozzles selected in a first one of the recording head units, nozzles selected in a second one of the recording head units are shifted in a direction of arrangement of the nozzles, and the amount of shift in position of a print formed by the second recording head unit with respect to a print formed by the first recording head unit is recognized.

Furthermore, in an ink jet recording method in which a plurality of recording head units which are detachably mounted each having N nozzles arranged in aline are used to perform a printing operation, printing is carried out while, with respect to nozzles selected in a first one of the recording head units, nozzles selected in a second one of the recording head units are shifted in a direction of arrangement of the nozzles, an amount of shift in position of a print formed by the second recording head unit with respect to a print formed by the first recording head unit is recognized, each of the plurality of recording head units selects n nozzles out of the N nozzles which can print in a common region of the plurality of recording head units, and each recording head unit and a recording medium are moved relative to each other as much as the print width of the n nozzles.

According to the invention, each recording head unit uses n nozzles which are selected out of the N nozzles according to the common print region of the plurality of recording head units. This arrangement absorbs the mounting errors of the recording head units. Furthermore, the number n of nozzles to be used is selected freely, and the recording medium is moved relative to the recording head unit as much as the print width of the n nozzles. Hence, graphic recording can be achieved with a desired print width.

Furthermore, the number n of nozzles selected for printing is the maximum number of nozzles which can print in the common print region of the plurality of recording head units. Therefore, the print width can be maximized, whereby printing can be performed with high efficiency.

Furthermore, the relative movement of each recording head unit and a recording medium is performed as much as the print width of the n nozzles selected. Hence, even if the number n of nozzles fluctuates depending on the recording head units, the resultant print has no break. Therefore, the apparatus is suitable for graphic recording.

Furthermore, the number n of nozzles which can print in the common region of the plurality of recording head units is determined according also to the minimum movement unit in the relative movement of each recording head and the recording medium. Hence, even if the minimum movement unit in the relative movement of the recording medium and each recording head unit is not of a single dot, the number n of nozzles can be so set as to absorb the amount of shift in position of the print, and a continuous graph can be recorded.

Furthermore, when it is determined that no print shift occurs, all the N nozzles are used. This dispenses with the nozzles which are not used for correction of the print shift, and therefore the width of a record formed by one scan of the carriage is increased as much. Accordingly the printing operation can be performed at higher speed.

Furthermore, printing is carried out while, with respect to nozzles selected in a first one of the recording head units, nozzles selected in a second one of the recording head units are shifted in the nozzle arrangement direction. Hence, the amount of shift in position of the print can be recognized by scanning the recording medium with the carriage only once or at most several times. If, in the case too where the recording head units are replaced, the print shift is corrected in the above-described manner, then records high in picture quality can be formed at all times.

Furthermore, the number n of nozzles selected in each recording head unit is not set to a predetermined value, and instead the number n of nozzles to be used is determined according to the amount of shift in position of a print formed by a test printing operation, and the relative movement of the recording head and the recording medium is performed as much as the print width of the n nozzles. Therefore, the print shift can be corrected according to the mounting conditions of the recording head units.

DETAILED DESCRIPTION OF PREFERRED EMBODIMENT

Figure 1:
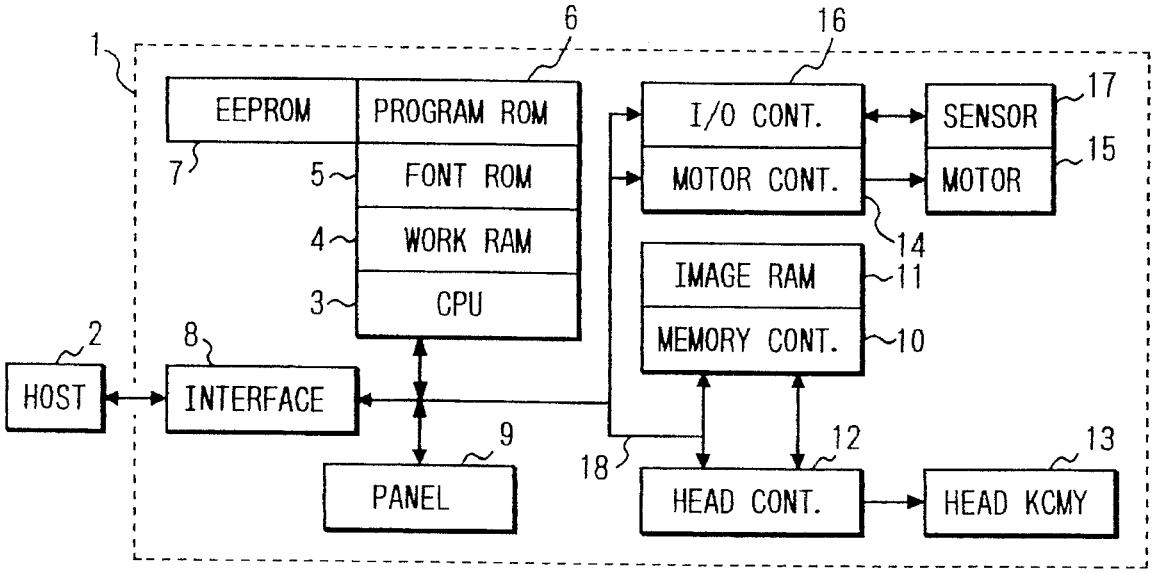
FIG. 1 is a block diagram showing the arrangement of an embodiment of an ink jet recording apparatus according to this invention.

FIG. 1 is a block diagram showing one example of an ink jet recording apparatus according to this invention. In FIG. 1, reference numeral 1 designates the ink jet recording apparatus; 2, a host computer; 3, a CPU (central processing unit); 4, a work RAM (random access memory); 5, a font ROM (read-only memory); 6, a program ROM; 7, an EEPROM (electrically erasable/programmable read-only memory); 8, an interface; 9, an operating panel; 10, a memory controller; 11, an image RAM, 12, a head controller; 13, a recording head comprising recording head units; 14, a motor controller; 15, an electric motor; 16, an I/O controller; 17, a sensor section; and 18, a common bus line.

The ink jet recording apparatus 1 is connected to the host computer 2, so that data are transmitted therebetween. The CPU 3 is connected to the work RAM 4, the font ROM 5, the program ROM 6, and the EEPROM 7, so as to operate by using them 4 through 7. The CPU 3 is further connected to the common bus line 18, to control various sections in the recording apparatus 1 through the bus line 18. The work RAM 4 is used as a memory region for the work of the CPU 3. The image type data of characters to be printed have been stored in the front ROM 5. A program for specifying the operations of the CPU 3 has been stored in the program ROM 6. The EEPROM 7 is a non-volatile memory; that is, data are kept stored in it even if the power supply is interrupted. Therefore, various set values for system operating modes, and data on the mounting errors between the recording head units (described later) are stored in the EEPROM 7.

The interface 8 is connected to the common bus line 18 and the host computer 2, for transmission of data to and from the latter 2. The operating panel 9 is connected to the common bus line 18, for reception of a variety of data from the operator and indication of a variety of states and messages to him.

The memory controller 10 is connected to the common bus line 18, and the head controller 12, to control the image RAM 11, in which data to be recorded are stored in the form of images. The memory region of the image RAM 11 may be divided into parts in correspondence to the recording head units.

The head controller 12 is connected to the recording head 13, the common bus line 18, and the memory controller 10, to control the recording head 13. The control of the recording head 13 includes at least control of the timing of jetting ink from the nozzles of the recording head units, and control of the temperature of ink. Alternatively, the control of the recording head 13 may include a part of the control of the CPU 3 that, for instance, nozzles to be used are controlled according to nozzle selection data (described later). The recording head 13 comprises a plurality of recording head units each having N nozzles. For instance in the case of a color printing machine, the recording head 13 is made up of four (4) recording head units of black (K), cyan (C), magenta (M) and yellow (Y).

The motor controller 14 is connected to the electric motor 15 and the common bus line 18, to control the motor 15. The motor 15 operates to move the carriage, on which the recording head 13 is mounted, relative to the recording medium such as a recording sheet. The I/O controller 16 is connected to the sensor section 17 including a plurality of sensors and the common bus line 18, to control the sensor section 17 and to read the output data of the latter 17. The sensor section 17 includes, for instance, a sheet edge detecting sensor, a sheet width detecting sensor, and an ink quantity detecting sensor.

The common bus line 18 is connected to the CPU 3, the interface 8, the operating panel 9, the memory controller 10, the head controller 12, the motor controller 14, and the I/O controller 16, for transmission of a variety of data and control signals.

As was described above, the ink jet recording apparatus is made up of a variety of circuit elements which are functionally different. However, the image RAM 11, and the work RAM 4 may be combined into one RAM, if necessary.

The operation of the system shown in FIG. 1 will be described. The CPU 3 operates according to the program stored in the program ROM 6 while referring to set values stored in the EEPROM 7. In this operation, the CPU 3 uses the work RAM 4 when necessary. The set values in the EEPROM 7 are stored through the operating panel 9. In addition, the CPU 3 receives data from the sensor section 17 with the aid of the I/O controller 17 to determine whether or not a recording operation can be performed, or issues instruction signals to the motor controller 14 to move the carriage or feed the recording sheet thereby to determine the recording position.

When data to be recorded such as image data and character codes are transmitted from the host computer 2, they are received by the interface 8, and supplied to the CPU 3. In the CPU 3, the data thus received are converted into image data which can be recorded. If the received data are character codes for instance, then the font ROM 5 is used to convert them into image data. The image data thus obtained are applied directly to the head controller 12, or stored once in the image RAM 11 with the aid of the memory controller 10. In the case where the image data are stored in the image RAM 11, they are read out by the memory controller 10 and applied to the head controller 12 according to instructions from the CPU 3 or the head controller 12. The head controller 12, receiving the image data to be recorded, controls the recording head 13 to perform a recording operation. The above-described series of operations are controlled by the CPU 3; however, transmission of data to the image RAM 11 and the head controller 12 from the interface 8 or the font ROM 5, and transmission of data to the head controller 12 from the image RAM 11 may be performed by DMA (direct memory access).

Figure 2:
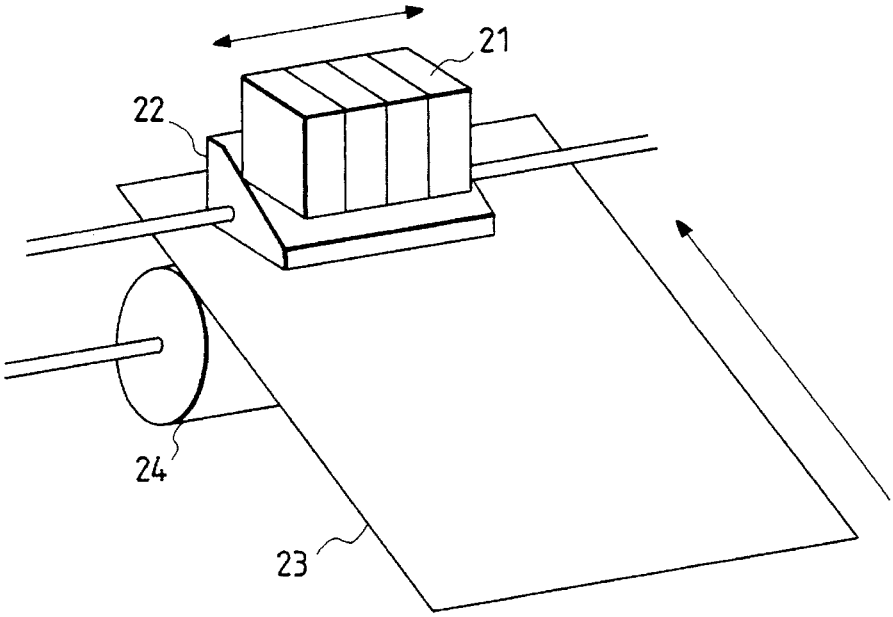
FIG. 2 is a perspective view showing a carriage and its relevant components in the ink jet recording apparatus.

FIG. 2 is a diagram showing the carriage and its relevant components in one example of the ink jet recording apparatus according to the invention. In FIG. 2, reference numeral 21 designates recording head units; 22, the carriage; 23, a recording medium; and 24, a transport roller. A plurality of recording head units are mounted on the carriage 21, and they may be installed or removed separately or as one unit. Each of the recording head units 21 has N nozzles (N is the number of nozzles). The carriage 22 is reciprocated horizontally, so as to make a record whose width corresponds to n nozzles which is part of the N nozzles ($n \leqq N$). In this recording operation, the plurality of recording head units 21 on the carriage 22 are driven, so that ink droplets jetted from the nozzles form dots in such a manner that the dots are put one on another to form the record. By using four recording head units of black, cyan, magenta and yellow, a color image can be printed. Hereunder, the description will be made with reference to a color ink jet recording apparatus with the above-described recording head units of four colors; however, it should be noted that it is applicable to an ink jet recording apparatus with a plurality of recording heads. According to the technical concept of the invention, gradation records can be formed with a plurality of recording head units of black color for instance.

When one scanning operation of the carriage 22 has been accomplished, the recording medium 23 is fed by the transport roller 22 as much as corresponding to the n nozzles of the recording head units 21 which have been used for recording. This operation is repeatedly carried out, thus accomplishing the printing of one recording sheet.

In the above-described embodiment, in order to change the printing position on the recording medium in the vertical direction, the recording medium is moved; however, the same effect can be obtained by moving the carriage 22 instead of the recording medium. The amount of movement is not limited to that which corresponds to the n nozzles; for instance, in the case where the carriage scans over a blank space, the amount of movement may be changed according to an instruction from the host computer 2. In addition, the amount of movement depends on the content of control of the CPU 3. In order to position the recording medium when the latter is fed, or a recording operation is carried out according to a predetermined format, the recording medium is moved according to an instruction from the CPU 3.

Figure 3:
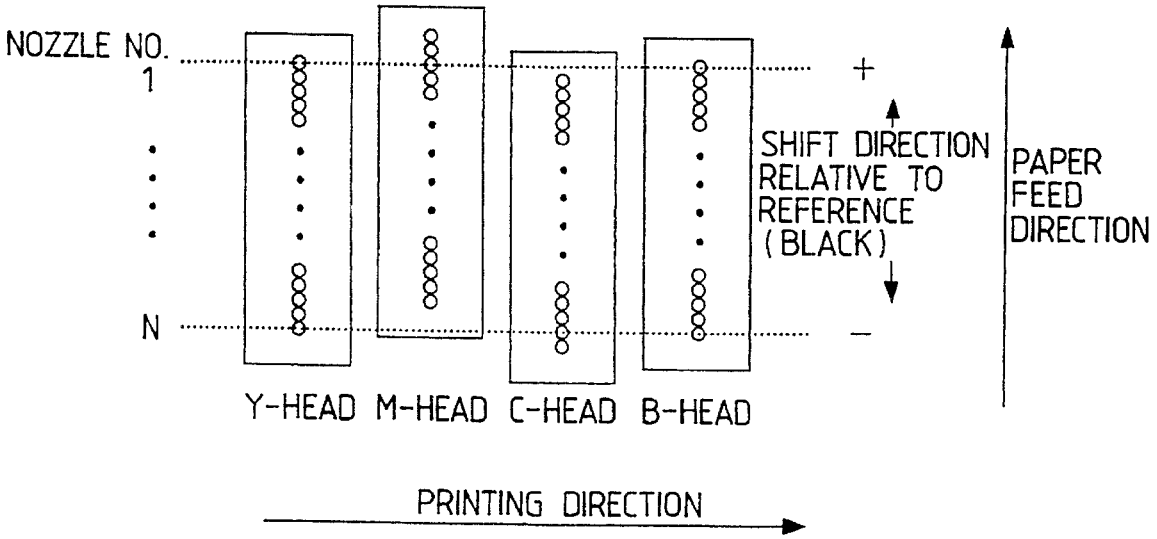
FIG. 3 is an explanatory diagram showing one example of the installation of recording head units in the recording apparatus.

FIG. 3 is a diagram outlining one example of the installation of the recording head. In FIG. 3, the sheet feeding direction is vertical, and the carriage scanning direction (or printing direction) is horizontal, and the recording head units of yellow, magenta, cyan and black are arranged in a left-to-right direction in the stated order. For convenience in description, the nozzles of each of the recording head units are numbered No. 1, No. 2, No. 3 and so forth from top.

As was described before, in installing a plurality of recording head units, the latter are shifted relative to one another because of their mechanical tolerances and mounting errors. Let us consider the case where the recording head units are shifted in the nozzle arrangement direction as shown in FIG. 3. If, in this case, it is assumed that the reference color is black, then the amount of shift of cyan dots is −1 dot, and the amount of shift of magenta dots is +2 dots. Therefore, if, under this condition, all the nozzles of the recording head are used as they are, then the resultant print will be shifted.

A method of detecting and correcting this print shift will be concretely described with reference to the case where the recording head is installed as shown in FIG. 3.

First, a test print mode will be described. The CPU 3 instructs the memory controller 10 to write data corresponding to eight (8) dots in the nozzle arrangement direction in the image RAM 11 at the corresponding address so that recording can be made by using the central eight (8) nozzles of the recording head unit of the reference color (black for instance). As for data on each of the colors other than black, control is made as follows: While the address where the data are to be written is shifted by one dot in the nozzle arrangement direction, the data are written as much as eight (8) dots.

Figure 5A:
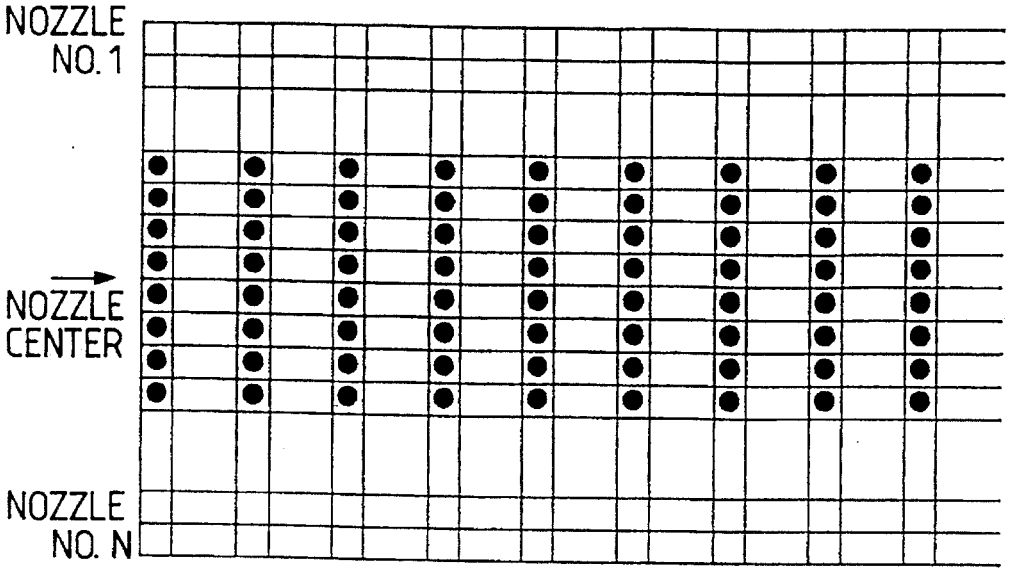
FIGS. 5A and 5B are explanatory diagrams showing examples of the arrangement of test print data in an image RAM in the recording apparatus.
Figure 5B:
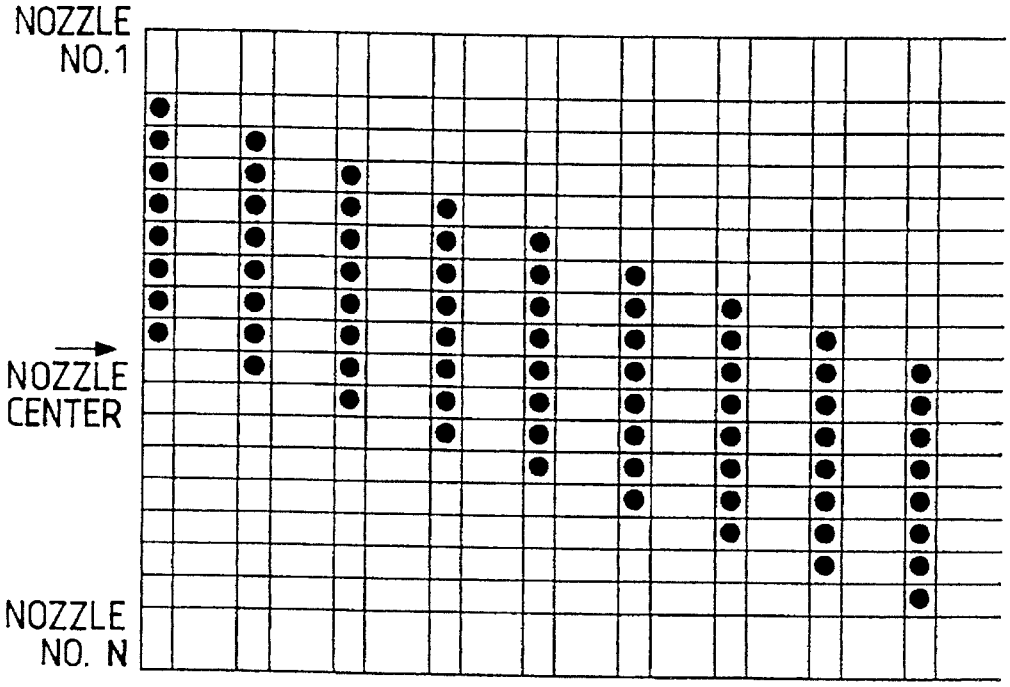

FIGS. 5A and 5B show examples of the arrangement of test print data in the image RAM. More specifically, FIG. 5A shows an example of the arrangement of test print data for black dots in the image RAM, and FIG. 5B shows an example of the arrangement of test print data for cyan dots therein.

Thus, the data for black dots written in the corresponding address of the image RAM 11 are located as shown in FIG. 5A, while the data for other than the black dots, for instance the data for cyan dots, are located as shown in FIG. 5B. As for the magenta dots or yellow dots, the data are written in the same manner.

The recording positions in the scanning direction are controlled as follows: That is, the printing timing is so controlled that, with respect to the positions of black dots, the positions of the other color dots are shifted by one column.

In the case of FIGS. 5A and 5B, the test print data is eight (8) dots for each of the recording head units, and the dots are shifted relatively in a range of from −4 dots to +4 dots, thus providing nine (9) shift patterns. In FIGS. 5A and 5B, the number of test print dots is eight (8); however, it may be changed (increased or decreased) as desired. In addition, the range of shifting the dots also may be increased or decreased. Theoretically, N (number of nozzles)-(number of print data) shift patterns is formed. Thus, the range should be set with the possible amount of shift taken into account. In general, the correcting operation should be achieved in a short time, and it is most desirable that the combination of colors is achieved in one scan of the carriage, and therefore the number of test print dots should not be increased so much. In addition, in order to detect the relative print shift with ease, it is preferable to employ a print arrangement of three blocks, black and cyan, black and magenta, and black and yellow.

Figure 6:
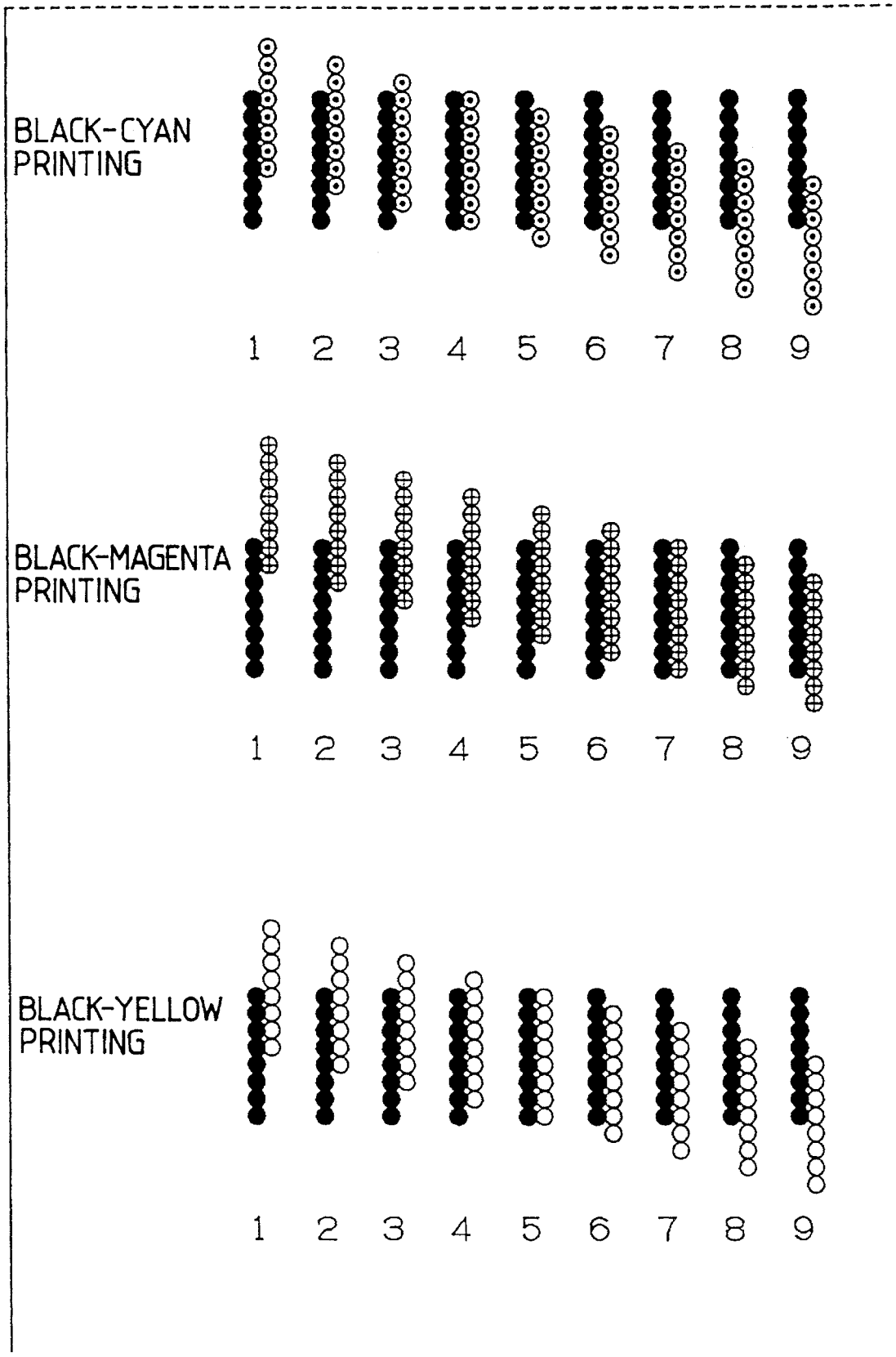
FIG. 6 is an explanatory diagram showing examples of the results of a test printing operation.

FIG. 6 is an explanatory diagram showing an example of the result of printing in the test print mode. When, in the case where the mounting errors exist as shown in FIG. 3, a test printing operation is carried out with the control made as described above, then the result of printing is as shown in FIG. 6. That is, FIG. 6 shows the result of the test printing operation in which the recording sheet is scanned three times forming black dots and cyan dots in combination, black dots and magenta dots in combination, and black dots and yellow dots in combination. In FIG. 6, for convenience in description, the dot pitch is shown larger than its true value. Each of the three prints each in two colors, shows nine (9) patterns in each of which the black dots are fixed, and the other color dots are shifted by one dot. Those nine (9) patterns are numbered by "1", "2", "3", . . . and "9" from left, respectively. Those number "1" through "9" may be printed above or below the patterns. In FIG. 6, the test printing operation is carried out by scanning the recording sheet with the carriage three times. However, the test printing operation may be carried out in such a manner that the three prints are positioned side by side in the scanning direction. In this case, the test printing operation can be achieved by scanning the recording sheet only once.

In the case of FIG. 6, the black dots and the cyan dots are aligned with each other at the number "4"; that is, at the number "4", the cyan dots in the second column are aligned with the black dots in the first column; similarly, the black dots and the magenta dots are aligned with each other at the number "7"; and the black dots and the yellow dots are aligned with each other at the number "5".

In the above-described test printing operation, the range in which the dot in the second column is shifted in position from the dot in the first column is set to −4 to +4. That is, the fact that, at the number "5", the dot in the second column is aligned with the dot in the first column, means that no color shift occurs with the reference color, black in this case. Thus, it can be understood that, in the case of FIG. 6, the recording head unit of yellow has no mounting error with respect to the recording head unit of black, and the recording head unit of cyan has a mounting error of "−1 dot" with respect to the recording head unit of black, and the recording head unit of magenta has a mounting error of "+2 dots" with respect to the recording head unit of black.

Now, the aforementioned print shift correcting method will be described in detail.

The operator or maintenance man inputs the amounts of shift according to the results of test printing. More specifically, he inputs through the operating panel the numbers where the dots in the second column align with the dots in the first column. For instance, when the test printing of black dots and cyan dots is resulted as shown in FIG. 6, then the number "4" is inputted. The system reads the number thus inputted to detect the mounting error of the mating recording head unit with respect to the recording head unit of black. If the numbers are printed below the test prints, respectively, then it will facilitate the above-described number inputing operation through the operating panel. In order to input the numbers, a switch may be provided on the operating panel which is operated as many times as the number to be inputted. In addition, the recording apparatus may be provided with a photo-electric conversion element, so that the test prints are read optically, and the print shift is automatically recognized.

When the amounts of shift of the recording head units are detected, the number of nozzles to be used by each of the recording head unit and the positions of the nozzles are determined. Those data can be obtained through simple arithmetic operations. The arithmetic operations are carried out by the CPU 3; however, the system may be so modified that the head controller 12 performs the arithmetic operations are performed.

It can be determined from the results of test printing shown in FIG. 6 that, with respect to the reference recording head unit, namely, the recording head unit of black, the recording head unit of cyan is maximally shifted in the negative (–) direction; that is, its amount of shift is –1, and the recording head unit of magenta is maximumly shifted in the positive (+) direction; that is, its amount of shift is +2. It can be determined from those values that the number of nozzles with which all the recording head units can print dots at the common positions is (N–3) in maximum, where N is the total number of nozzles.

The positions of nozzles used by each recording head unit can be determined from the respective amount of shift. For instance, the recording head unit of black cannot use the upper nozzles the number of which corresponds to the maximum amount of shift in the negative (–) direction with the recording head unit of black as a reference, and the lower nozzles the number of which corresponds to the maximum amount of shift in the positive (+) direction. Therefore, the recording head unit of black can use the (N–3) nozzles, up to the (N–2)-th nozzle from the nozzle No. 2. Similarly, with the recording head unit of cyan as a reference, the maximum amount of shift in the negative (–) direction is 0, and the maximum amount of shift in the positive (+) direction is +3, and therefore the nozzles which can be used are up to the (N–3)-th nozzle from the nozzle No. 1. Similarly, the recording head unit of magenta can use the nozzles up to the N-th nozzle from the nozzle No. 4, and the recording head unit of yellow can use the nozzles up to the (N–2)-th nozzle from the nozzle No. 2.

Figure 4:
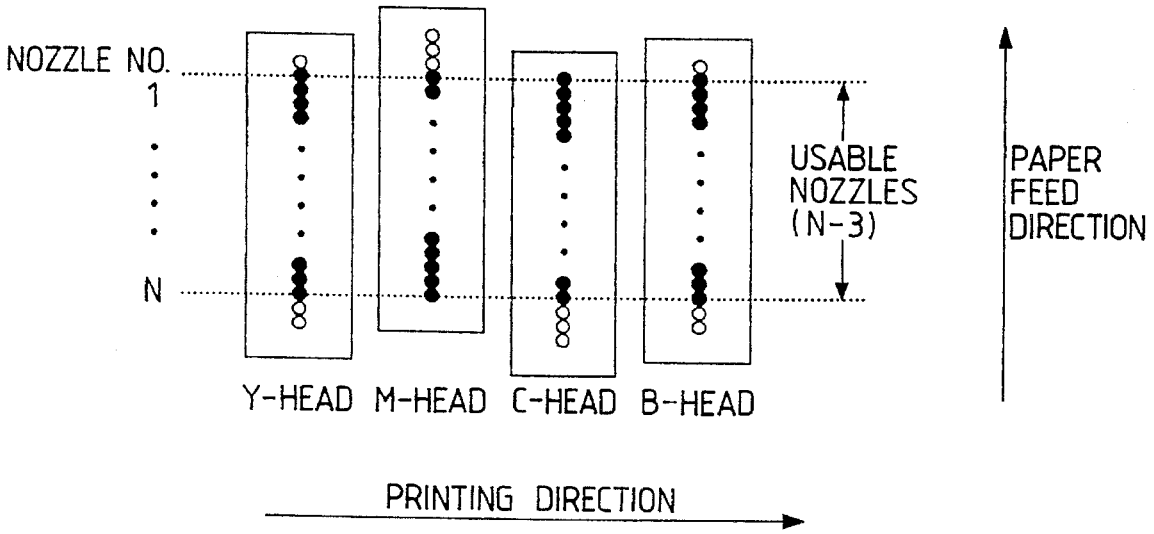
FIG. 4 is an explanatory diagram for a description of the number of nozzles to be used, and the locations of them.

FIG. 4 shows the numbers of nozzles which can be used (hereinafter referred to as "usable nozzles", when applicable) and the positions of them. Those usable nozzles are shown shaded in FIG. 4. The number of usable nozzles of each recording head unit, and the positions of them can be determined as shown in FIG. 4.

In the above-described embodiment, recording is carried out with (N–3) nozzles. However, in practice, sometimes it is impossible to use a single dot as a minimum unit in feeding a recording sheet (hereinafter referred to as "a minimum sheet feed unit", when applicable). Therefore, in this case, an optimum condition is selected through comparison of the maximum number of usable nozzles with the minimum sheet feed unit. For instance, in the case where the recording sheet cannot be fed for (N–3) nozzles, the maximum number of usable nozzles, but can be fed for (N–4) nozzles, the number of usable nozzles is set to (N–4), and the positions of the usable nozzles are rearranged. In this case, in each of the recording head units, use of the top or bottom nozzle is inhibited.

The numbers of usable nozzles of the recording head units, and the positions of them are stored, as data on the mounting errors between the recording head units, in the EEPROM 7.

Thus, a series of steps in the print shift correcting operation have been accomplished. That is, the numbers of nozzles which the recording head units can use in a printing operation, and the positions of those nozzles have been determined. The printing operation is carried out on the basis of the values thus determined unless the print shift correcting operation is carried out again in association with the replacement of the recording head units.

The above-described number of usable nozzles is the maximum value of nozzles which can be used for printing. Therefore, it goes without saying that the number of nozzles which are actually used may be smaller than the maximum value if it permits the feeding of the recording sheet. However, for instance in the case of graphic printing, the printing speed is proportional to the width which printing covers in one scan, and therefore in order to perform a graphic printing operation at high speed, it is preferable for each recording head unit to use all the nozzles which are available.

Figure 7:
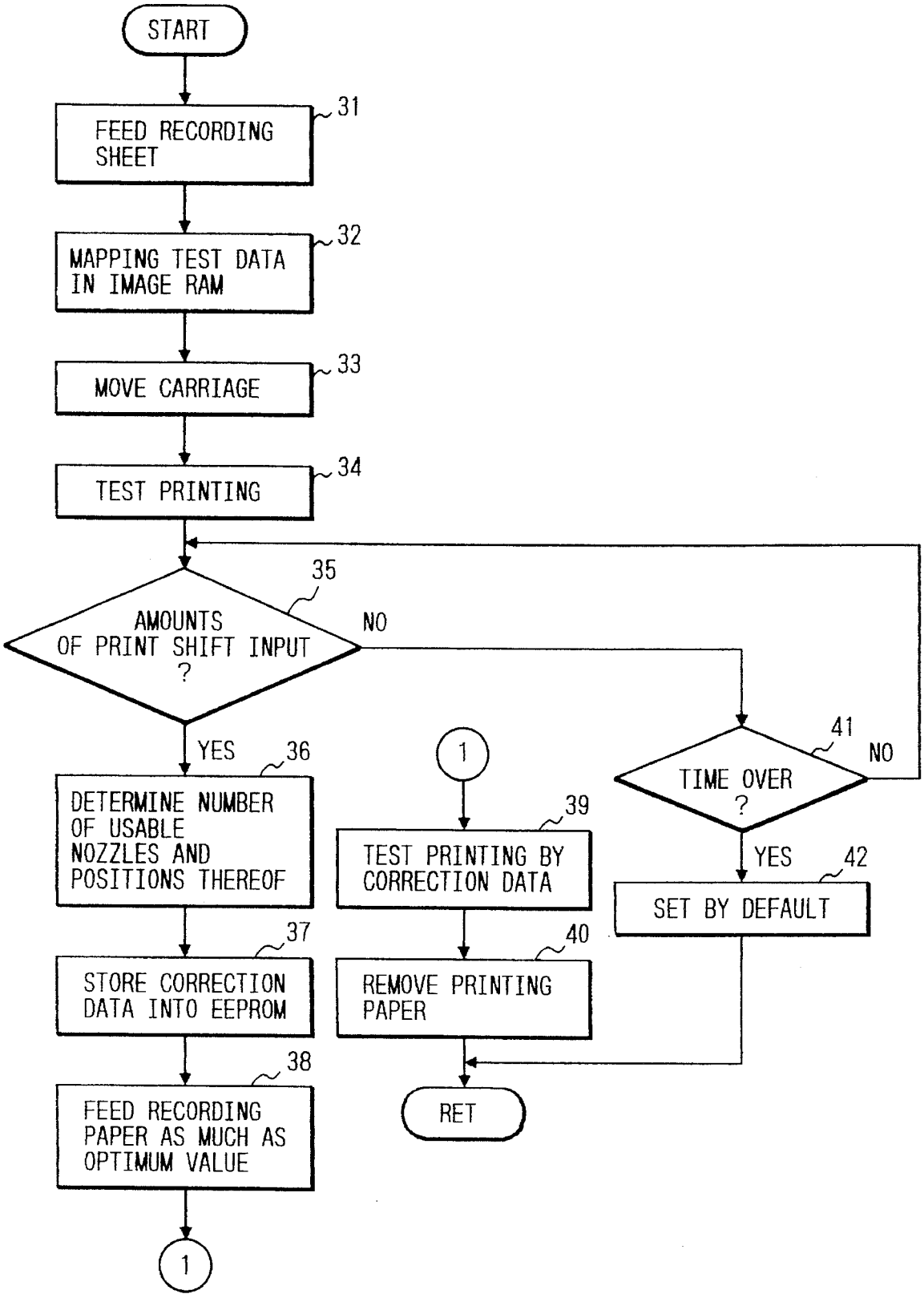
FIG. 7 is a flow chart for a description of a print shift correcting operation.

FIG. 7 is a flow chart for a description of the print shift correcting operation.

The various steps in the above-described print shift correcting operation may be summarized as shown in FIG. 7. First, in Step 31, a recording sheet is fed for a test printing operation. Next, in Step 32, test data are stored in the image RAM 11 as shown in FIG. 5. In Step 33, the carriage is moved, and in Step 34, the test printing operation is carried out.

After the test printing operation, the amounts of print shift are inputted by the operator or maintenance man. In Step 35, it is counted how many amounts of print shift are inputted. In the above-described color printing, three amounts print shift are inputted. While the amounts of print shift are inputted, the lapse of time is monitored. That is, in Step 41 it is determined whether or not a predetermined period of time has passed before three amounts of print shift are inputted.

When the three amounts of print shift have been inputted, Step 36 is effected. In Step 36, the amounts of print shift thus inputted, and the amount of feed of the recording sheet are utilized to determine the number of usable nozzles and the positions of the latter. The data thus determined are stored in the EEPROM 7.

In order to inform the operator or maintenance man of the data thus stored, in Step 38 the recording sheet is fed as much as the optimum value. In Step 39, the test printing is performed by scanning the recording sheet just once according to the correcting data. In Step 40, the recording sheet used for the test printing is removed. Thus, the print shift correcting operation has been accomplished.

On the other hand, when no amounts of print shift are inputted in Step 35, and the predetermined period of time has passed in Step 41, it means that no print shift correcting operation is required. Therefore, in this case, predetermined default values are set, and the print shift correcting operation is terminated.

In the case where it is determined as a result of the test printing operation that the print shift is not so large, or it is determined that the print shift may be disregarded, it is unnecessary to perform the print shift correcting operation. In this case, the printing operation is carried out according to predetermined default data.

In the case where it is determined as a result of the ordinary printing operation that the print shift may be ignored, it is unnecessary to perform the test printing operation or print shift correcting operation. In this case also, the printing operation is performed according to the predetermined default data.

The default data may be so set that all of N nozzles of each recording head units are used. This is advantageous in that, if the recording apparatus is free from print shift, the maximum print width of the recording head can be used; that is, the printing operation can be performed with high efficiency.

The recording apparatus may be operated without use of the default data. In this case, the operator or maintenance man inputs the number of nozzles used by each recording head unit and the positions of them through the operating panel.

As is apparent from the above description, according to the invention the print shift due to the mounting errors, in the nozzle arrangement direction, of the recording head units on the carriage is reduced to less than a half (½) dot, which dispenses with a mechanism for finely adjusting the mounting of the recording head units; that is, the mounting mechanism of the recording head units can be simplified as much. Furthermore, since the nozzles are selected with the amount of feed of the recording sheet taken into account, graphic patterns high in picture quality can be printed at high speed at all times.

In the case where the recording head units are free from mounting errors, the nozzles regarded as correcting nozzles also may be used for an ordinary printing operation; that is, the performance of the recording heads can be fully utilized. Thus, a printer system high in cost performance can be provided according to the invention.

What is claimed is:

1. An ink jet recording apparatus, comprising:

a plurality of detachably mounted recording head units for performing a printing operation;

each of said recording head units having a number of aligned nozzles equal to a positive integer N;

recording head control means for allowing each of said recording head units to use n nozzles, where n is a positive integer equal to or less than N, within a common print region of said plurality of recording head units, to perform the printing operation, including means for selecting said integer n based on an actual length of said common print region extending in a direction of said aligned nozzles.

2. An ink jet recording apparatus as claimed in claim 1, wherein the number n of nozzles thus selected is a maximum number of nozzles which can print in the common print region of said plurality of recording head units.

3. An ink jet recording apparatus as claimed in claim 1, further comprising:

control means for performing movement of the recording head units relative to a recording medium as much as a print width of said n nozzles thus selected.

4. An ink jet recording apparatus as claimed in claim 2, further comprising:

control means for performing movement of the recording head units relative to a recording medium as much as a print width of said n nozzles thus selected.

5. An ink jet recording method in which a plurality of recording head units, which are detachably mounted with each of said recording head units having a number of aligned nozzles equal to a positive integer N, are used to perform a printing operation, said ink jet recording method comprising the steps of:

selecting n nozzles from each of said N nozzles where n is a positive integer equal to or less than N, the n nozzles corresponding to a common print region of said plurality of recording head units, including the substep of varying said integer n based on an actual length of said common print region in a direction of said aligned nozzles; and printing by the selected n nozzles.

6. An ink jet recording method as claimed in claim 5, wherein the n nozzles thus selected is a maximum number of nozzles which can print in the common print region of said plurality of recording head units.

7. An ink jet recording method as claimed in claim 5, wherein the n nozzles thus selected is the number of nozzles which is determined according also to a minimum movement unit in movement of a member supporting the recording head units relative to a recording medium.

8. An ink jet recording method as claimed in claim 6, wherein the n nozzles thus selected is determined according also to a minimum movement unit in movement of a member supporting the recording head units relative to a recording medium.

9. An ink jet recording method as claimed in 5, wherein a detection is made of no print shift, and when no print shift is detected, n equals N so that all of the N nozzles mounted on each recording head unit are used for printing.

10. An ink jet recording method in which a plurality of recording head units are detachably mounted to perform a printing operation with each of said recording head units having N aligned nozzles where N is a positive integer, said ink jet recording method comprising the steps of:

printing with use of nozzles selected in one of said recording head units and with use of nozzles selected in each of other ones of said recording head units, while the selected nozzles in said each of other ones of said recording head units are gradually shifted in a direction of arrangement of said nozzles;

detecting an amount of shift in position of a print formed by said each of other ones of said recording head units with respect to a print formed by said one of said recording head units; and selecting n nozzles, where n is a positive integer equal or less than N, in each of said recording head units, said n nozzles being located within a common print region of said recording head units, said selecting being based on said amount of shift detected for said each of said recording head units.

11. An ink jet recording method in which a plurality of recording head units are detachably mounted to perform a printing operation with each of said recording head units having N aligned nozzles where N is a positive integer, said ink jet recording method comprising the steps of:

printing with use of nozzles selected in one of said recording head units and with use of nozzles selected in each of other ones of said recording head units, while the selected nozzles in said each of other ones of said recording head units are gradually shifted in a direction of arrangement of said nozzles;

detecting an amount of shift in position of a print formed by said each of other ones of said recording head units with respect to a print formed by said one of said recording head units;

selecting n nozzles, where n is a positive integer equal to or less than N, in each of said recording head units, said nozzles being located within a common print region of said recording head units, said selecting being based on said amount of shift detected for said each of said recording head units; and moving the recording head units and a recording medium relative to each other as much as a print width of the n nozzles.

12. An ink jet recording apparatus comprising:

a plurality of recording heads which are arranged with respective sets of aligned nozzles in parallel;

means for determining amounts of relative positional shifts of said plurality of recording heads; and nozzle setting means for setting nozzles used for printing by said recording heads according to said amounts of relative positional shifts;

said nozzle setting means selecting nozzles of said recording heads, said nozzles being located within a maximum common print region which is defined by a nozzle provided outermost in a first direction on a recording head which is most shifted in a second direction opposite said first direction, and by a nozzle provided outermostly in said second direction on a recording head which is most shifted in said first direction.

13. An ink jet recording apparatus as claimed in claim 12, in which said recording heads are so arranged as to confront a recording medium, the apparatus further comprising: nozzle resetting means for reducing, when the number of nozzles thus selected does not match an amount of relative movement, in the direction of arrangement of nozzles, of said recording heads and said recording medium, the number of nozzles thus set to correspond to said amount of relative movement.

14. An ink jet recording apparatus as claimed in claim 12, wherein said recording heads are so arranged as to confront a recording medium, the apparatus further comprising: drive means for driving said recording medium and said recording heads relative to each other in the direction of arrangement of nozzles; and drive unit setting means for setting a drive unit for said drive means, said drive unit setting means setting said drive unit to a value corresponding to the number of nozzles thus selected.

15. An ink jet recording apparatus comprising:

a plurality of recording heads which are so arranged as to confront a recording medium, each of said recording heads having a plurality of nozzles;

means for setting amounts of relative positional shifts of said plurality of recording heads; and nozzle setting means for setting a number of the nozzles used for printing by said recording heads, according to said amounts of relative positional shifts thus set and a minimum unit in movement of said recording heads relative to said recording medium.

* * * * *

UNITED STATES PATENT AND TRADEMARK OFFICE

CERTIFICATE OF CORRECTION

PATENT NO. : 5,539,434

DATED : July 23, 1996

INVENTOR(S) : Takeshi FUSE

It is certified that error appears in the above-indentified patent and that said Letters Patent is hereby corrected as shown below:

In claim 1, Column 11, line 55, after "operation," insert --said recording head control means--.

Claim 5, Column 12, line 15, after "units," insert --said step of selecting n nozzles--.

Signed and Sealed this

Seventh Day of January, 1997

Bruce Lehman

*Attest:*

BRUCE LEHMAN

*Attesting Officer*

*Commissioner of Patents and Trademarks*